US006345774B1

(12) United States Patent
Calhoun

(10) Patent No.: US 6,345,774 B1
(45) Date of Patent: Feb. 12, 2002

(54) SPRAY BOTTLE SPRAY HEAD

(76) Inventor: Patricia D. Calhoun, 69 Ball St., Newnan, GA (US) 30263

( * ) Notice: Subject to any disclaimer, the term of this patent is extended or adjusted under 35 U.S.C. 154(b) by 0 days.

(21) Appl. No.: 09/569,456

(22) Filed: May 12, 2000

(51) Int. Cl.[7] ..... B05B 9/043
(52) U.S. Cl. ..... 239/333; 239/558; 222/383.1
(58) Field of Search ..... 239/331, 329, 239/333, 375, 526, 558, 556, 548; 222/383.1, 207

(56) References Cited

U.S. PATENT DOCUMENTS

| | | | | | |
|---|---|---|---|---|---|
| 87,321 | A | * | 3/1869 | Barrows | 239/558 |
| 92,194 | A | * | 7/1869 | Kaiser | 239/375 |
| 166,164 | A | * | 7/1875 | Vose | 239/558 |
| 1,895,307 | A | * | 1/1933 | Beck | 239/548 |
| 2,081,798 | A | | 5/1937 | Dinneen | |
| 2,119,884 | A | | 6/1938 | Lohse | |
| 2,185,534 | A | | 1/1940 | Bernhardi | |
| D212,351 | S | | 10/1968 | Srobe | |
| 3,770,206 | A | * | 11/1973 | Tada | 239/375 |
| 4,174,056 | A | * | 11/1979 | Loeffler | 239/333 |
| D258,800 | S | | 4/1981 | Halbeisen et al. | |
| 4,775,078 | A | | 10/1988 | Schick et al. | |
| 5,819,989 | A | * | 10/1998 | Saraceni | 222/383.1 |
| 6,189,811 | B1 | * | 2/2001 | Rudy | 239/375 |

* cited by examiner

*Primary Examiner*—David A. Scherbel
*Assistant Examiner*—Christopher S. Kim

(57) ABSTRACT

A spray bottle spray head for spraying a fluid therefrom over a large area. The spray bottle spray head includes a bottle with a pump body coupled thereto. A generally frusta-conical spray head is coupled to the pump body. The spray head has a generally circular front face and tapers from the front face of the spray head to the pump body. The front face of the spray head has a plurality of spaced apart spray apertures therein.

1 Claim, 2 Drawing Sheets

25
17
13
22
27
22
15
16
18
20
24
11
10

28
28
26
25
27
29
30
13
22
15

18
20
19
12
10
11

SPRAY BOTTLE SPRAY HEAD

BACKGROUND OF THE INVENTION

1. Field of the Invention

The present invention relates to hand-pumped spray bottles and more particularly pertains to a new spray bottle spray head for spraying a fluid therefrom over a large area.

2. Description of the Prior Art

The use of hand-pumped spray bottles is known in the prior art. More specifically, hand-pumped spray bottles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,775,078; 2,119,884; 2,185,534; 2,081,798; Des. 212,351; and Des. 258,800.

While these devices fulfill their respective, particular objectives and requirements, the aforementioned patents do not disclose a new spray bottle spray head. The inventive device includes a bottle with a pump body coupled thereto. A generally frusta-conical spray head is coupled to the pump body. The spray head has a generally circular front face and tapers from the front face of the spray head to the pump body. The front face of the spray head has a plurality of spaced apart spray apertures therein.

In these respects, the spray bottle spray head according to the present invention substantially departs from the conventional concepts and designs of the prior art, and in so doing provides an apparatus primarily developed for the purpose of spraying a fluid therefrom over a large area.

SUMMARY OF THE INVENTION

In view of the foregoing disadvantages inherent in the known types of hand-pumped spray bottles now present in the prior art, the present invention provides a new spray bottle spray head construction wherein the same can be utilized for spraying a fluid therefrom over a large area.

The general purpose of the present invention, which will be described subsequently in greater detail, is to provide a new spray bottle spray head apparatus and method which has many of the advantages of the hand-pumped spray bottles mentioned heretofore and many novel features that result in a new spray bottle spray head which is not anticipated, rendered obvious, suggested, or even implied by any of the prior art hand-pumped spray bottles, either alone or in any combination thereof.

To attain this, the present invention generally comprises a bottle with a pump body coupled thereto. A generally frusta-conical spray head is coupled to the pump body. The spray head has a generally circular front face and tapers from the front face of the spray head to the pump body. The front face of the spray head has a plurality of spaced apart spray apertures therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new spray bottle spray head apparatus and method which has many of the advantages of the hand-pumped spray bottles mentioned heretofore and many novel features that result in a new spray bottle spray head which is not anticipated, rendered obvious, suggested, or even implied by any of the prior art hand-pumped spray bottles, either alone or in any combination thereof.

It is another object of the present invention to provide a new spray bottle spray head which may be easily and efficiently manufactured and marketed.

It is a further object of the present invention to provide a new spray bottle spray head which is of a durable and reliable construction.

An even further object of the present invention is to provide a new spray bottle spray head which is susceptible of a low cost of manufacture with regard to both materials and labor, and which accordingly is then susceptible of low prices of sale to the consuming public, thereby making such spray bottle spray head economically available to the buying public.

Still yet another object of the present invention is to provide a new spray bottle spray head which provides in the apparatuses and methods of the prior art some of the advantages thereof, while simultaneously overcoming some of the disadvantages normally associated therewith.

Still another object of the present invention is to provide a new spray bottle spray head for spraying a fluid therefrom over a large area.

Yet another object of the present invention is to provide a new spray bottle spray head which includes a bottle with a pump body coupled thereto. A generally frusta-conical spray head is coupled to the pump body. The spray head has a generally circular front face and tapers from the front face of the spray head to the pump body. The front face of the spray head has a plurality of spaced apart spray apertures therein.

Still yet another object of the present invention is to provide a new spray bottle spray head that is ideal for spraying hair spray or other hair care products on the head of a user because it sprays fluid over a larger area of the user's head than traditional spray bottles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
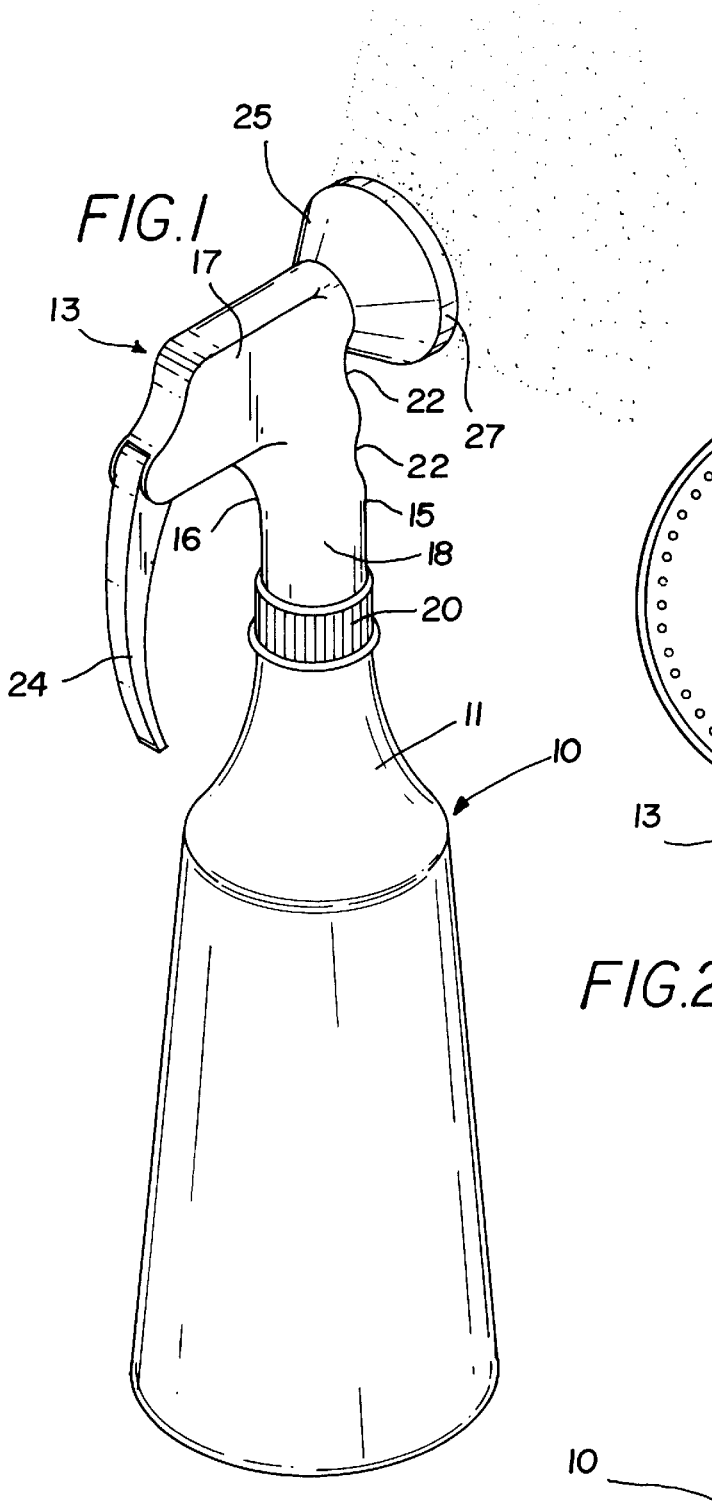
FIG. 1 is a schematic perspective view of a new spray bottle spray head according to the present invention.
Figure 2:
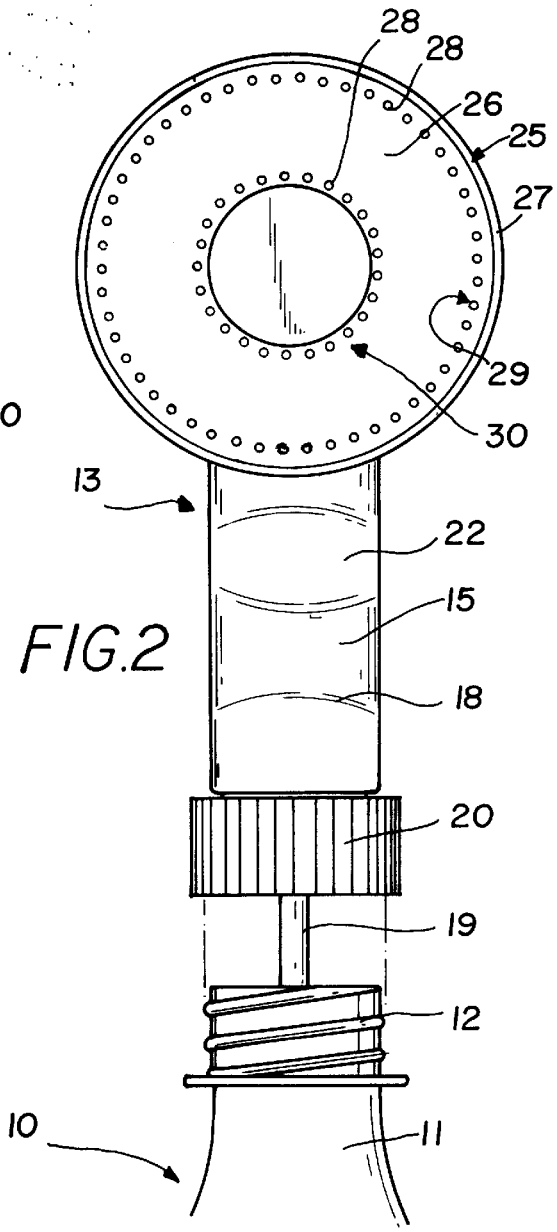
FIG. 2 is a schematic exploded front view of the present invention.
Figure 3:
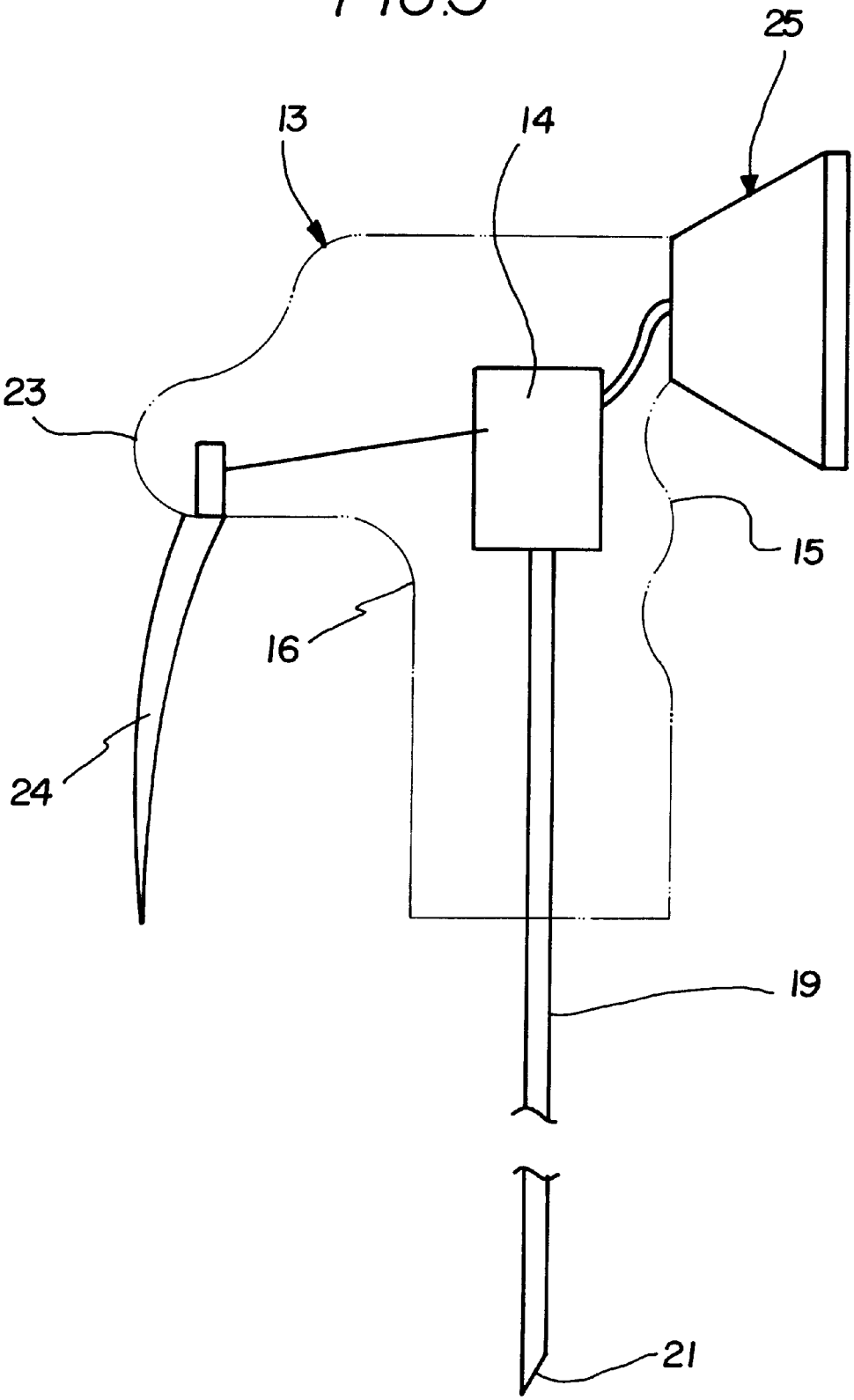
FIG. 3 is a schematic diagram of the present invention illustrating the connections of the pumping mechanism to spray head.

With reference now to the drawings, and in particular to FIGS. 1 through 3 thereof, a new spray bottle spray head embodying the principles and concepts of the present invention will be described.

As best illustrated in FIGS. 1 through 3, the spray bottle spray head generally comprises a bottle with a pump body coupled thereto. A generally frusta-conical spray head is coupled to the pump body. The spray head has a generally circular front face and tapers from the front face of the spray head to the pump body. The front face of the spray head has a plurality of spaced apart spray apertures therein.

In closer detail, a bottle 10 or similar container is provided for holding a volume of fluid therein such as hairspray. The bottle preferably has a tapered neck 11 terminating at a threaded open upper end 12.

A pump body 13 is provided having a fluid pump 14 therein, a front 15, a back 16, and upper and lower portions 17,18. The lower portion of the pump body has an elongate draw tube 19 downwardly extending therefrom, and a threaded fastening ring 20 rotatably mounted thereto and disposed around the draw tube. The draw tube is inserted through the upper end of the bottle into the bottle and the fastening ring is threaded onto the upper end of the bottle to coupled the pump body to the upper end of the bottle. The draw tube is in fluid communication with the fluid pump in the pump body and has an open lower end 21 for permitting fluid in the bottle to be drawn up into draw tube upon pumping action by the fluid pump.

The front of the pump body preferably has a plurality of a finger grooves 22. The finger grooves are designed for receiving portions of a user's fingers therein when the user grasps the pump body. The upper portion of the pump body also has a rear extent 23 outwardly extending from the back of the pump body.

A pump lever 24 is pivotally coupled to and downwardly depending from the rear extent. The pump lever is spaced apart from the lower portion of the pump body. The pump lever preferably has a concavity facing towards the lower portion of the pump body. The pump lever is biases in a direction away from the lower portion of the pump body by a spring or other biasing means commonly used in spray bottle pumps. In use, the pump lever is designed for placement adjacent the palm of a user's hand grasping the pump body so that the user's hand may be used to pivot the pump lever closer towards the lower portion of the pump body.

This arrangement of the pump lever is especially a preferred arrangement for user has long fingernails. With this arrangement, long fingernails of a user do not interfere with the pumping of the spray bottle (as compared to traditional forwardly positioned pivot levers) and thereby also helps to reduce the risk of breaking and damaging the fingernails of a user and any fingernail polish therein.

The pump lever is operatively connected to the fluid pump such that pivoting of the pump lever towards the lower portion of the pump body in turn operates the fluid pump to draw fluid from the bottle up into the draw tube and up into the pump body.

A generally frusta-conical spray head 25 is coupled to the front of the pump body adjacent the upper portion of the pump body. The spray head has a generally circular front face 26. The spray head tapers from the front face of the spray head to the front of the pump body so that the outer diameter of the spray head is greatest at the front face of the spray head. The spray head preferably has an annular front lip 27 outwardly extending therefrom around the outer perimeter of the front face of the spray head. The front lip is designed for blocking lateral spray out of the spray head.

The front face of the spray head has a plurality of spaced apart spray apertures 28 therein. The spray apertures are preferably arranged in a pair of concentric rings 29,30 on the front face of the spray head each concentric with the center of the front face of the spray head. The spray apertures are ideally spaced apart at substantially equal intervals in the respective ring of spray apertures. An outer ring 29 of spray apertures of the pair of rings of spray apertures is extend around the front face of the spray head adjacent the front lip of the spray head. The outer ring of spray apertures is interposed between the front lip and an inner ring 30 of spray apertures of the pair of rings of spray apertures. The outer ring of spray apertures is spaced closer to the front lip than to the inner ring of spray apertures. Ideally, the outer ring of spray apertures is spaced at least five times closer to the front lip than to the inner ring of spray apertures.

In a preferred embodiment, the front face of the spray head has an outer diameter between about 1 inch and about 6 inches, and in an ideal embodiment, between about 2 inches and about 3 inches. In an ideal embodiment, the outer ring of spray apertures has a diameter of between about 1¾ inches and about 2¾ inches and the inner ring of spray apertures has a diameter of between about ½ inch and about 1 inch.

In use, the spray apertures are in fluid communication with the fluid pump such that fluid pumped from the bottle by the fluid pump is sprayed out of the spray apertures in a spray over a generally conical area in front of the front face of the spray head to cover a large region with the sprayed fluid. This way, fewer squeezes are needed to be performed for a user to cover a desired area. It should also be understood that this spray head will also work on aerosol spray containers to spray larger areas than with traditional spray heads found on aerosol containers such as aerosol hair sprays.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A spray bottle, comprising:

a bottle for holding a volume of fluid therein, said bottle having a threaded open upper end;

a pump body having a front, a back, and upper and lower portions;

said lower portion of said pump body having an elongate draw tube downwardly extending therefrom, and a threaded fastening ring rotatably mounted thereto and disposed around said draw tube;

said draw tube being inserted through said upper end of said bottle into said bottle, said fastening ring being threaded onto said upper end of said bottle to coupled said pump body to said upper end of said bottle;

said front of said pump body heaving a plurality of a finger grooves;

said upper portion of said pump body having a rear extent outwardly extending from said back of said pump body;

a pump lever being pivotally coupled to and downwardly depending from said rear extent, said pump lever being spaced apart from said lower portion of said pump body;

said pump lever having a concavity facing towards said lower portion of said pump body;

said pump lever being biased in a direction away from said lower portion of said pump body;

said pump lever being adapted for placement adjacent the palm of a user's hand grasping said pump body so that the user's hand may be used to pivot the pump lever closer towards the lower portion of the pump body;

a generally frusta-conical spray bead being coupled to said front of said pump body adjacent said upper portion of said pump body;

said spray head having a generally circular front face, said spray bead tapering from said front face of said spray head to said front of said pump body;

said spray head having an annular front lip outwardly extending therefrom around said front face of said spray head;

said front face of said spray head having a plurality of spaced apart spray apertures therein, said spray apertures being arranged in a pair of concentric rings on said front face of said spray head;

said spray apertures being spaced apart at substantially equal intervals in the respective ring of spray apertures;

an outer ring of spray apertures of said pair of rings of spray apertures being extend around said front face of said spray head adjacent said front lip of said spray head;

said outer ring of spray apertures being interposed between said front lip and an inner ring of spray apertures of said pair of rings of spray apertures; and said outer ring of spray apertures being spaced closer to said front lip than to said inner ring of spray apertures.

* * * * *